United States Patent [19]

Layh et al.

[11] Patent Number: 4,633,602

[45] Date of Patent: Jan. 6, 1987

[54] METHOD AND APPARATUS FOR PADDING PIPE

[76] Inventors: Ricky L. Layh, P.O. Box 2272; Christy B. Landrum, Jr., 1227 Short St., both of Hobbs, N. Mex. 88240

[21] Appl. No.: 771,840

[22] Filed: Sep. 3, 1985

[51] Int. Cl.[4] ..... E02F 1/00

[52] U.S. Cl. ..... 37/195; 37/142.5

[58] Field of Search ..... 37/142.5, 195; 414/334, 414/335-336, 725, 528; 171/10, 123, 136, 138, 140, 141

[56] References Cited

U.S. PATENT DOCUMENTS

| | | | |
|---|---|---|---|
| 2,947,096 | 8/1960 | Cummings et al. | 37/142.5 |
| 3,596,384 | 12/1971 | Neujahr | 37/142.5 |
| 3,670,909 | 6/1972 | Holland | 414/343 |
| 3,701,422 | 10/1972 | Downey | 37/142.5 |
| 3,981,089 | 9/1976 | Burrows | 37/142.5 |
| 4,055,255 | 10/1977 | Vasquez | 414/725 |
| 4,055,265 | 10/1977 | Eisenman | 414/528 X |
| 4,057,917 | 11/1977 | Burrows | 37/142.5 |
| 4,221,505 | 9/1980 | Taylor-Smith | 37/142.5 |
| 4,301,910 | 11/1981 | Price | 37/142.5 |
| 4,377,365 | 3/1983 | Layh | 414/334 |

*Primary Examiner*—E. H. Eickholt

*Attorney, Agent, or Firm*—Marcus L. Bates

[57] ABSTRACT

Apparatus for gathering and processing excavated material which lies in a long pile on the ground adjacent to a ditch, so as to provide padding material which is conveyed onto a pipe lying in the ditch, with the residue from the process being returned to the ground adjacent to the ditch. The apparatus has a gathering head at the forward end thereof and a separator at the rear end thereof. A longitudinally arranged conveyor translocates the gathered material from the gathering head onto the separator. A lateral conveyor underlies the separator and translocates processed material which passes through the screen into the ditch, to thereby cover a pipeline with padding material. The separator apparatus includes means for redepositing the residual material onto the ground along a path parallel to the ditch.

5 Claims, 9 Drawing Figures

METHOD AND APPARATUS FOR PADDING PIPE

BACKGROUND OF THE INVENTION

In my previous U.S. Pat. No. 4,377,365 issued Mar. 22, 1983, there is disclosed apparatus for handling padding material. Reference is made to my previous U.S. Pat. No. 4,377,365 as well as the art cited therein. Reference is also made to U.S. Pat. Nos. 3,981,089 and 4,057,917 (N. B. Burrows), and to the art cited therein for still further background of this invention.

In the building of cross country pipelines, it is customary for the ditch digging apparatus to form the ditch in advance of the subsequent pipe laying operation. The pipe is layed into the ditch as soon as possible after the excavation operation to avoid the ditch caving and contaminating the pipe with harmful debris. It is therefore desirable to cover the pipe with suitable padding material as soon as the pipe has been layed, and to lay the pipe as soon as the ditch has been dug.

As evidenced by the above prior art, padding material often is especially prepared and transported many miles in order to provide the pipe with proper padding material. It is therefore desirable that the costly step of transporting padding material from a location removed from the pipeline job be eliminated so as to avoid the enormous cost associated therewith. Furthermore, it is desirable that the padding operation be carried out immediately following the pipe laying operation. Further, it is considered advantageous to return similar or compatible material into the ditch which is consistent with the geological characteristics of the geological formation through which the pipeline is formed.

Apparatus and method by which excavated material is processed to obtain suitable padding material for a pipeline, while the residual excavated material is returned to its previous location adjacent to the ditch, is the subject of the present invention.

SUMMARY OF THE INVENTION

This invention comprises method and apparatus for processing padding material from the excavated material which results from digging the ditch. The apparatus is in the form of a ground supported vehicle which moves parallel and adjacent to a ditch while picking up and processing the previously excavated material which was deposited in a continuous pile coextensive with and spaced from the ditch.

After a ditch is dug and the pipeline has been placed into the ditch, the processing apparatus of this invention is moved parallel and adjacent to the ditch while a gathering head at the forward end of the apparatus gathers a predetermined amount of the previously excavated material from the continuous pile of excavated material. This is achieved by raising or lowering the leading end of the gathering head as the apparatus moves along the ground.

The gathering head includes a pair of gathering arms which operate in a manner whereby all of the excavated material engaged by the leading edge of the gathering head is moved onto a longitudinally arranged inclined conveyor. The inclined conveyor elevates the excavated material and drops the material onto a separator means.

The separator means, in the preferred embodiment of this invention, has a screen size consistent with the texture of the padding material desired for padding the specific pipe that lies in the ditch. The separator screen is manipulated in a manner whereby the rate at which the excavated material moves thereacross can be changed in order to provide a second control over the amount of processed material that is ultimately returned to the ditch as padding material.

The separator therefore is inclined at a suitable angle to control the amount of processed padding material that travels through the screen. The residual material travels across the screen and gravitates back onto the remains of the original pile of material located at one side of the ditch.

A lateral conveyor underlies the separator. The lateral conveyor receives the padding material that passes through the screen and conveys the separated material to one side of the apparatus where the end of the lateral conveyor is positioned in overlying relationship respective to the ditch, whereupon the padding material is translocated from the apparatus onto the pipe lying in the ditch.

The lateral conveyor can be shifted laterally so as to properly align either end of the lateral conveyor with a ditch extending alongside the moving apparatus, and accordingly, the apparatus of this invention is adapted for use regardless of which side of the ditch the pile of excavated material may be placed.

A primary object of the present invention is the provision of method and apparatus for processing excavated material from a ditch to provide padding material for a pipeline lying in the ditch.

Another object of the present invention is the provision of a process by which a predetermined amount of excavated material from a pipeline ditch can be gathered up and conveyed to an elevated position where the material is separated into padding material and residual material, with the residual material being returned to the location of the original excavated material, and the padding material being moved laterally into a position to gravitate back into the ditch and thereby cover a pipe lying in the ditch with suitable padding material.

A further object of this invention is the provision of apparatus for processing padding material for a pipeline by using previously excavated material from the ditch comprising: lifting a predetermined amount of the excavated material while traveling along a path which is parallel to the pipeline, separating the gathered material into padding and residual material, covering the pipeline with the padding material, and returning the residual material to the ground.

A still further object of this invention is the provision of method and apparatus for picking up and conveying excavated material which was deposited on the ground during a ditch digging operation, separating the conveyed material into residual material and padding material, returning the residual material to the ground, placing the padding material about a pipeline which lies in the ditch, while the apparatus is traveling along a path which is parallel to the pipe and ditch.

Another and still further object of the present invention is the provision of a system for picking up excavated material from a ditch digging operation, separating the excavated material into padding material, returning the residual material back to the pile of excavated material while translocating the padding material onto a pipeline located in the ditch, thereby manufacturing padding material and covering the pipe with padding material while traveling alongside the ditch.

An additional object of this invention is the provision of a new combination of elements by which excavated material resulting from the formation of a pipeline ditch can be processed into padding material while traveling parallel to a previously dug ditch.

These and various other objects and advantages of the invention will become readily apparent to those skilled in the art upon reading the following detailed description and claims and by referring to the accompanying drawings.

The above objects are attained in accordance with the present invention by the provision of a method for use with apparatus fabricated in a manner substantially as described in the above abstract and summary.

DETAILED DESCRIPTION OF THE PREFERRED EMBODIMENTS

Figure 1:
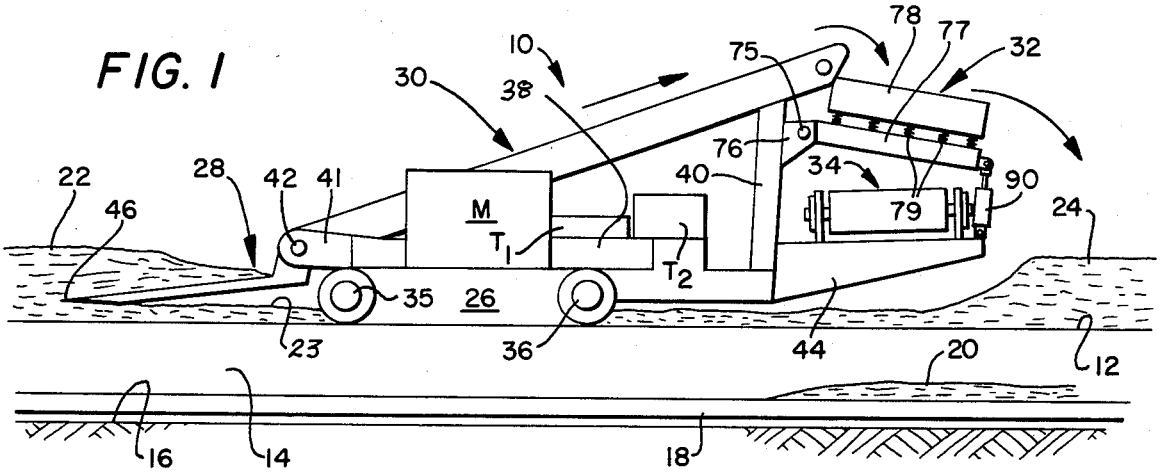
FIG. 1 is a part diagrammatical, part schematical, side elevational view illustrating an apparatus and process which can be carried out in accordance with the present invention.

In the figures of the drawings, there is disclosed apparatus 10 for gathering and processing excavated material which lies on the ground 12 adjacent to a ditch 14. The ditch 14 has a bottom 16 and sidewalls, and is of a sufficient depth to properly accommodate a pipeline 18 therewithin. Padding material 20, for padding and protecting the pipeline 18, covers the pipeline 18. The padding material 20 has been processed by the apparatus 10, in accordance with this invention.

As seen in FIG. 1, together with other figures of the drawings, excavated material 22 lies in a continuous pile which extends longitudinally adjacent to and parallel to the ditch 14. The excavated material 22 is processed by the apparatus 10 to provide the before mentioned padding material 20 and residual excavated material 24. Numeral 23 represents a variable amount of the excavated material 22 which is not processed by the apparatus 10.

In FIG. 1, together with other figures of the drawings, the apparatus 10 is seen to include a track assembly 26 comprised of an endless track, known to those skilled in the art.

A gathering head 28, known to those skilled in the art, is formed at the forward end of the apparatus 10 and gathers excavated material 22 which is forced onto the inclined, longitudinally disposed conveyor 30. The gathered material 22 is conveyed by conveyor 30 onto a separator means 32, the details of which will be more fully discussed later on in this disclosure. A lateral conveyor 34 underlies the separator 32 and thereby receives and conveys the separated material 20 into the ditch 14. The separated material 20 is referred to herein as padding material and is the fines resulting from the separation at 32, 34. The padding material has characteristics known to those skilled in the art and is of a selected size to protect the pipe surface from sharp rocks and the like.

Figure 3:
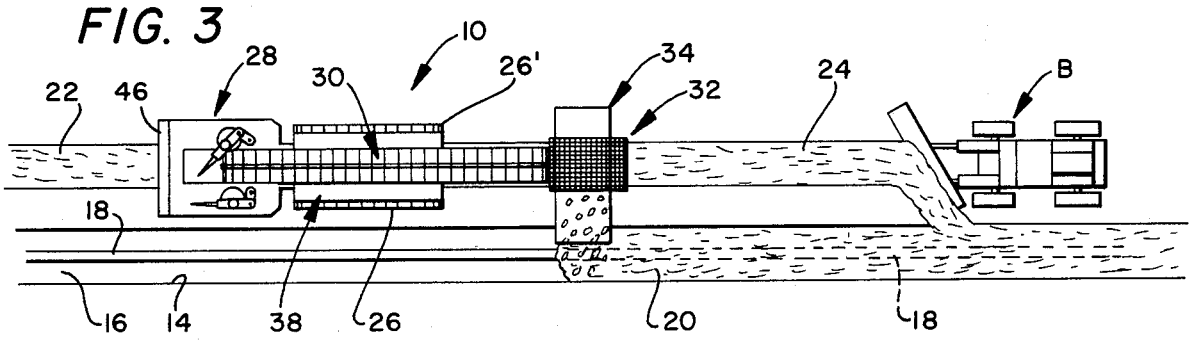
FIG. 3 is a top, plan view of the apparatus seen disclosed in FIG. 1.
Figure 4:
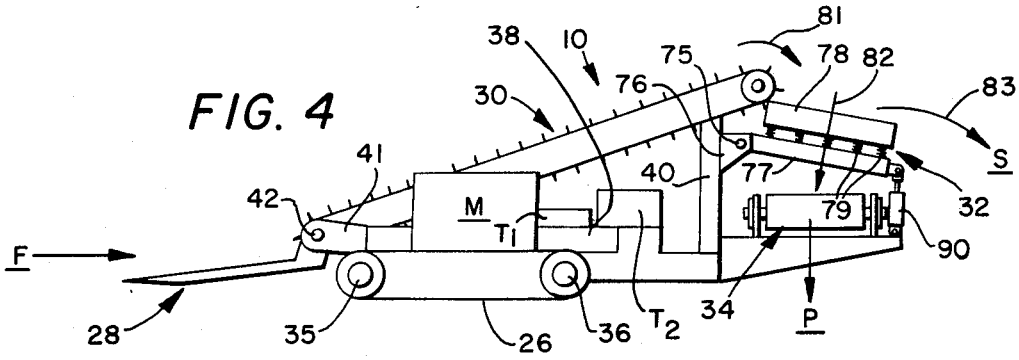
FIG. 4 is a schematical, side elevational view of the process disclosed in the foregoing figures.

As seen in FIGS. 1, 3, and 4, together with other figures of the drawings, the track assembly 26 includes fore and aft track sprockets 35 and 36 which are spaced apart and drive the track, thereby enabling the apparatus 10 to move along a path which is adjacent and parallel to the ditch 14. The apparatus 10 includes a main frame 38 to which the track and gathering head is mounted in supported relationship therewith, and to which the conveyor 30 is suitably supported. Numerals 40 and 41 indicate one form of a support means by which the inclined conveyor 30 is suitably disposed in supported relationship respective to the remainder of the apparatus.

Numeral 42 indicates a journal means by which the gathering head 28 is suitably mounted in journaled relationship respective to the main frame 38, so that a predetermined amount of the excavated material 22 can be intercepted and removed by the gathering head by pivoting the leading end of the gathering head about the pivot point formed at the journal 42. A rear frame extension 44 lends support to the lateral conveyor 34.

Figure 5:
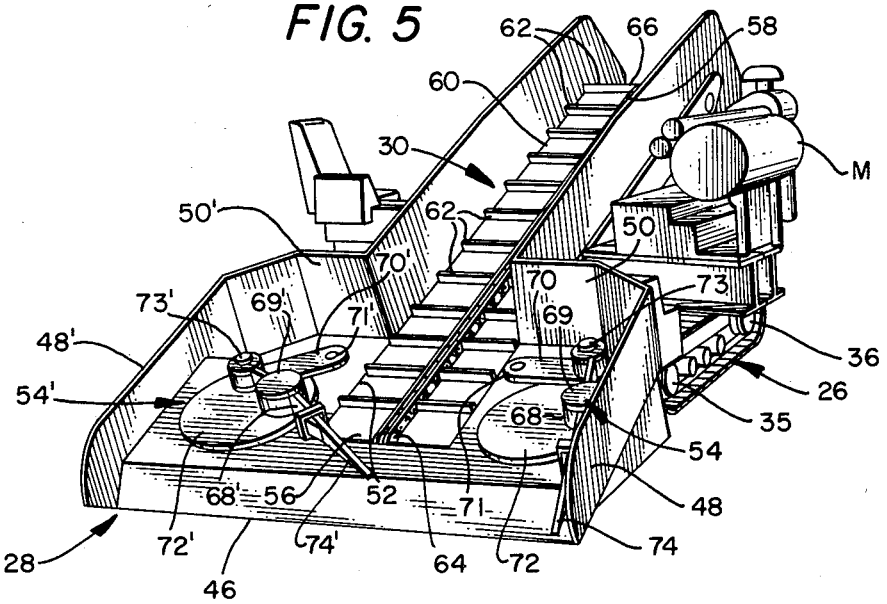
FIG. 5 is a front, perspective view of one form of the invention.
Figure 6:
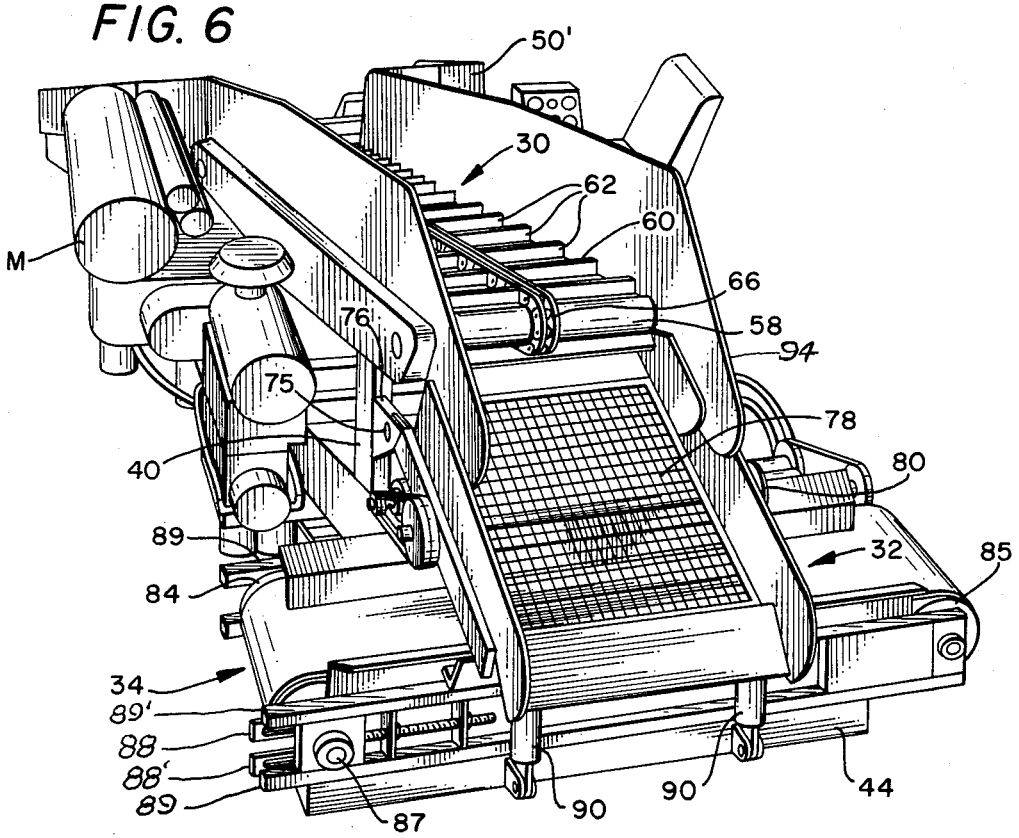
FIG. 6 is a rear, perspective view of the apparatus disclosed in FIG. 5.

The front edge 46 of the gathering head 28 can therefore be elevated or lowered as may be desired. As seen in FIG. 5, the gathering head 28 includes opposed sides 48, 48' and spaced rear walls 50, 50'. A centrally located trough 52 is arranged in aligned relationship respective to the conveyor 30 and receives the lower marginal end of the conveyor therein. A pair of gathering arms 54, 54' are arranged for movement in a complex pattern, and operate to extend forwardly of front edge 46 where the forward part of each arm gathers excavated material 22 and sweeps over the central trough 52, thereby gathering material into the trough 52 and forcing the material onto the inclined conveyor 30. In FIG. 5, the numeral 56 indicates the forward end while numeral 58 of FIG. 6 indicates the rear end of the inclined conveyor 30. An endless chain 60, comprised of individual chain elements 62, are meshed with respect to the illustrated front and rear chain sprockets 64, 66 by which the endless chain 60 is forced to move and to thereby convey the excavated material from the gathering head onto the separator 32.

The gathering arms 54, 54' comprise a bicep 68 having one end thereof journaled at 69, a forearm 70 having one end thereof journaled at 71, and a rotating plate member 72 to which the forearm is eccentrically journaled at 73. Picks 74 are removably received within a cavity formed at the outer marginal end of the forearm. The details of the gathering arms and rotating plate are known to those skilled in the mining industry.

Figure 2:
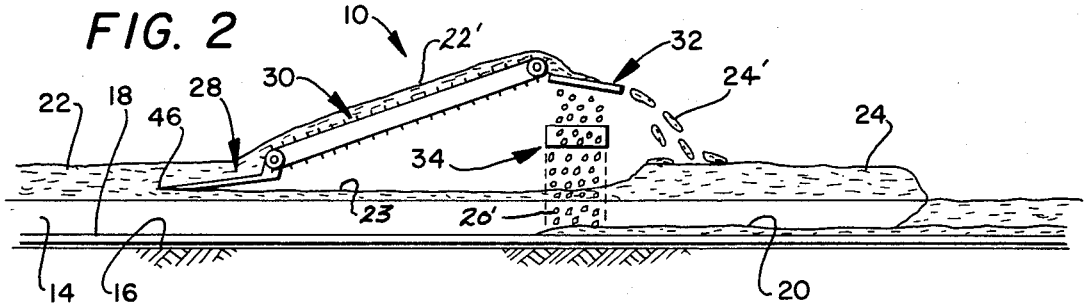
FIG. 2 is a diagrammatical representation of the process carried out with the apparatus of FIG. 1.
Figure 7:
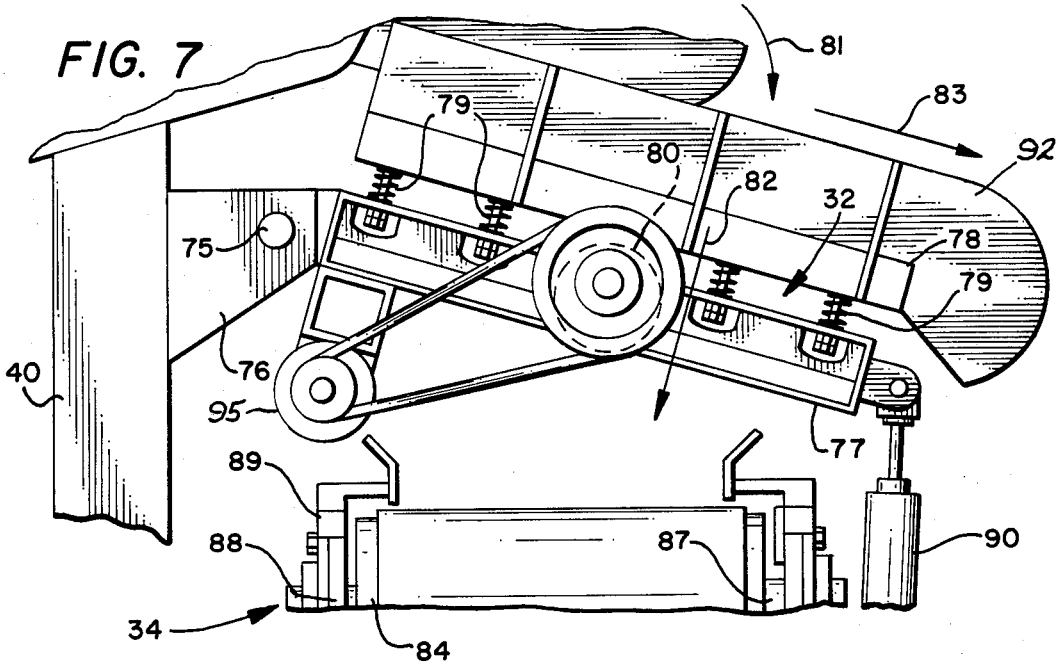
FIG. 7 is an isolated, detailed view of part of the apparatus disclosed in some of the foregoing figures.
Figure 8:
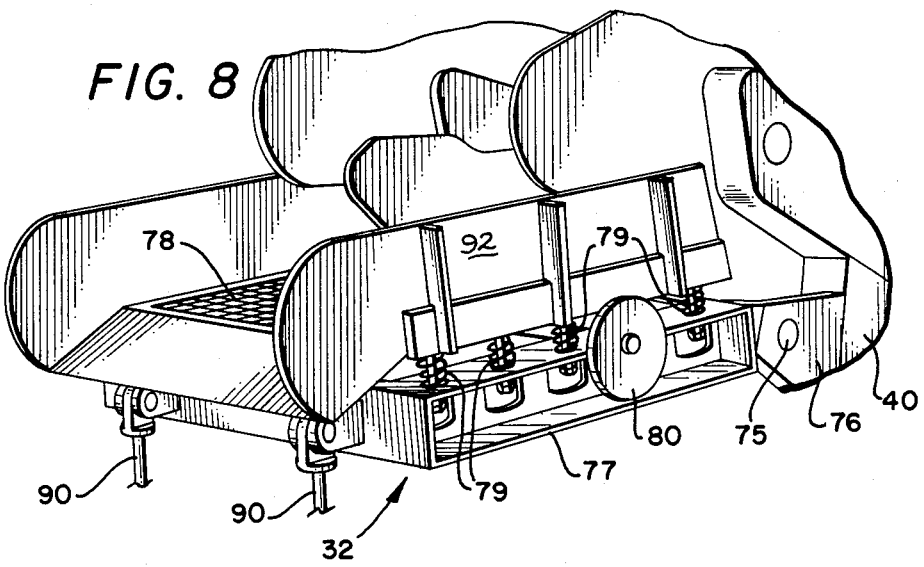
FIG. 8 is a detailed view of the separator apparatus previously disclosed in FIG. 7; and, FIG. 9 is an end view of the apparatus disclosed in FIG. 6.

In FIGS. 6–9, the separator means 32 is shown pivotally attached at 75 to member 76, which in turn is attached to the before mentioned vertical support member 40. Elevators 90, preferably in the form of hydraulically actuated cylinder assemblies, control the angle of inclination of the separator means 32. The separator includes a lower frame member 77 which supports an upper vibrator screen 78 by means of a spring suspension system. The suspension system includes a multiplicity of individual springs 79 which jointly resiliently support the screen 78. An eccentric weight 80 is attached to the illustrated hydraulically actuated shaft to impart vibratory motion into the spring supported screen 78. In FIG. 7, the arrow at numeral 81 indicates the path of travel of the conveyed excavated material which gravitates from the rear or discharge end 58 of conveyor 30 onto the screen. Numeral 82 indicates the path of travel of the processed material which passes through the screen 78. Numeral 83 indicates the path of travel of the remaining conveyed material, or the residual material that fails to pass through the screen 78 and accordingly, is redeposited onto the pile 23 of excavated material seen at 24 in FIG. 2.

Figure 9:
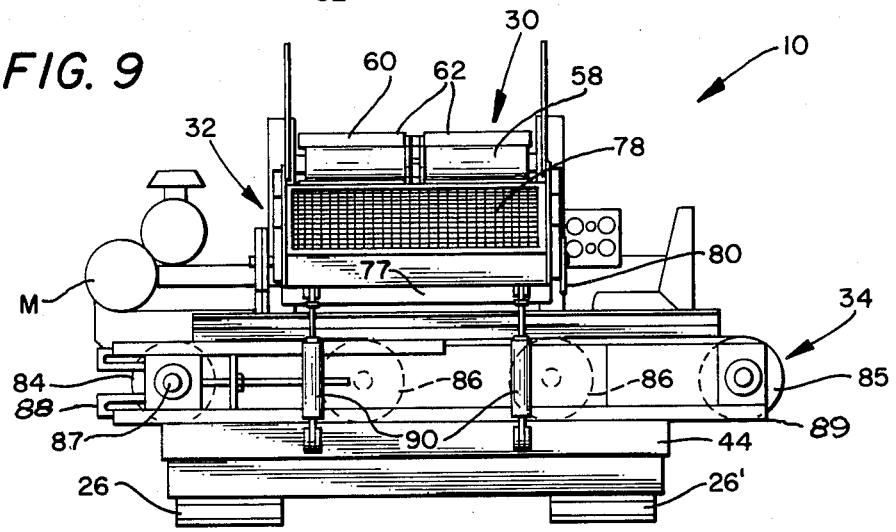

FIG. 9, together with other figures of the drawings, show that the lateral conveyor 34 includes opposed end rollers 84, 85 and intermediate rollers 86. The rollers 84, 85, and 86 are each supported by shaft 87 and in journaled relationship respective to the opposed slidable frame member 88. End roller 84 is adjustably mounted respective to the opposed end roller 85 to thereby enable adjustment of the conveyor belt tension. The rollers are each supported by the slidable frame member 88. Frame member 88 is captured to fixed elongated frame member 89, which is supported by the rear frame extension 44. The construction enables the lateral conveyor to be moved approximately 36 inches laterally respective to the main frame 38.

Hydraulically actuated cylinders 90 are supported between the frame extension 44 and the separator lower frame member 77, and pivots the separator about pin 75, thereby enabling the separator screen 78 to be inclined at any desired angle. The separator includes side members 92 attached to the opposed sides of the screen assembly. The conveyor 30 likewise includes side members 94 which overlap the side members 92, as best seen illustrated in FIGS. 6–8.

FIG. 7 shows that the eccentric weight 80 is shaft driven by a belt and pully arrangement, with a motor 95 driving the belt. The motor 95 is mounted to the frame member 77 while the shaft which drives the eccentric weight is journaled to the screen 78.

In operation, the gathering head 28 of apparatus 10 gathers excavated material 22' from the pile 22 and forces the material 22' onto the conveyor 30 where the excavated material is translocated by the conveyor 30 into overlying relationship respective to the separator 32. A large quantity of the separated material proceeds across the inclined screen of the separator 32, as indicated by the arrow at 83. This residual material is redeposited onto the remains of pile 22, as indicated by the numeral 24 of FIG. 1. The padding material, that is, the material passing through the screen 78 as indicated by numeral 82, gravitates onto the lateral conveyor 34 where the illustrated endless belt translocates the padding material laterally respective to the direction of travel and into the ditch 14. Roller 84, for example, is positioned in overhanging relationship respective to the ditch 14 so that padding material supported thereon is discharged into the ditch and thereby covers the pipe 18, as noted by numeral 20 in FIGS. 1–3.

During operation, the operator controls the entire apparatus from the illustrated seat and console. The apparatus is powered by motor M (FIG. 4) which drives transmissions T1 and T2. The gathering head arms preferably are driven by a hydraulic motor (not shown). The gathering head pivots about pins 42 by means of a hydraulic cylinder (not shown). Track assembly 26 is of conventional design and supports and propels the entire apparatus. Lateral conveyor 34 and inclined conveyor 30 each are actuated by appropriate hydraulic motors according to prior art expedients.

The operator positions the apparatus 10 to travel along a path which is parallel to the side of the ditch 14 that previously received the excavated material 22. The tracks 26 of machine 10 straddle the pile 22 in the illustrated manner of FIG. 3. The gathering head 28 is lowered until leading edge 46 thereof cuts into and lifts a fraction of the excavated material 22 in the manner of FIG. 1. The gathering arms 54, 54' gather in the fraction of material and forces the material to move onto the inclined traveling conveyor 30. The excavated material travels up the conveyor 30, as noted at 22' of FIG. 2, and falls onto the separator 32.

The inclination of separator 32 is adjusted by means of hydraulic cylinders 90 to control the rate at which the material 22' progresses across the screen 78 of separator 32, which also controls the amount of separated material 20 that passes through screen 78, as noted by the arrow at numeral 82 of FIG. 4, for example.

The lateral conveyor 34 is positioned by moving the conveyor laterally respective to the machine to thereby discharge the padding material into the ditch 14. The rate of vibration of screen vibrator apparatus 80, 95 is also adjusted to effect the desired separation. The operator rapidly gains the skills required to employ the proper angle of the gathering head, oscillatory speed of gathering arms, track speed or velocity of the entire apparatus 10, speed of conveyor, angle of separator 32, vibration rate of the screen, and the location and speed of the lateral conveyor.

In FIG. 3, a bulldozer B is schematically illustrated for replacing or backfilling the residual material 24 into the pipeline ditch 14, thereby completing the job. It is considered within the comprehension of this invention to return the discharge 24' (FIG. 2) directly into the ditch 14, if desired, thereby augmenting the backfill operation.

The present invention enables a pipeline job to be progressively built wherein only a few hundred feet of open ditch is exposed to the hazards of the elements. A ditch digging machine can be closely followed by the pipe laying crew, which in turn is closely followed by the apparatus 10, thereby avoiding the liabilities associated with an open pipeline ditch.

It is preferred that 6–8 inches of padding material 20 cover the pipe (FIGS. 2 and 3) in order to protect the pipe from the more coarse rock. Usually about $\frac{1}{3}$–$\frac{1}{2}$ of the excavated material 22 is gathered onto the conveyor 30 for treatment.

A chute can be arranged at the discharge end of the lateral conveyor 34, if desired, to more accurately direct the padding material 20 onto the pipe 18.

The apparatus 10 can travel along the ditch 14 faster than the pipe 16 can be laid, that is, a slow walk or $\frac{1}{2}$ mph.

The screen size at 78 can be changed to cause the processed padding material to be more compatible with the geological characteristics of the strata through which the ditch extends. Double screens of different sizes can be employed so that fines cover the pipe, followed by mediums, which in turn is covered with the residual material.

We claim:

1. Apparatus for continuously moving along the ground parallel to a ditch while continuously gathering and processing excavated material which lies on the ground adjacent to a pipeline ditch so as to enable padding material to be separated from the gathered material and conveyed back into the ditch, with the residue from the processed material being returned to the ground adjacent to the ditch;

said apparatus having a longitudinal conveyor arranged parallel to the path of travel of the apparatus, and means forming a gathering head at the forward marginal end of the conveyor for gathering excavated material from the ground and forcing the excavated material onto the leading end of the conveyor; said conveyor having a forward end opposed to a discharge end and translocates the gathered material rearwardly to an elevated position;

means by which said gathering head is pivotally mounted to said apparatus and forms the forward marginal end thereof; said gathering head has a ground engaging lip at the forward end thereof, said gathering head can be pivotally moved vertically respective to the excavated material in order to gather a controlled amount of excavated material for subsequently processing into padding material;

a separator means supported at the rear end of the apparatus for separating padding material and residual processed material from the translocated gathered material; said separator means being located in underlying relationship respective to the discharge end of the longitudinal conveyor;

a lateral conveyor means positioned in underlying relationship respective to the separator means for translocating the padding material received from the separator into the ditch and thereby covering a pipe which may be located in the ditch;

and means for redepositing the residual processed material from the separator onto the remaining said material which lies on the ground along a path which is parallel to the ditch.

2. The apparatus of claim 1 wherein said gathering head includes a central slot at the rear thereof within which the forward end of the longitudinal conveyor is received; said gathering head includes spaced picks, means mounting said picks on opposed sides of the forward end of the longitudinal conveyor, said picks move in a circular manner to engage and gather in material located on said lip and sweep the material onto the longitudinal conveyor.

3. A process by which excavated material resulting from the formation of a ditch can be picked up from a continuous pile of said excavated material that lies adjacent and parallel to the ditch, processed into padding material, and the padding material then translocated back into the ditch in overlying relationship respective to a pipeline lying therein; and, the residual separated material is translocated back onto the excavated material remaining in the pile; comprising the following steps:

continuously moving a vehicle along a path adjacent and parallel to the ditch while continuously gathering at least the upper part of the pile of excavated material; and, continuously forcing the gathered material onto an inclined conveyor which moves material therein in a direction parallel to the ditch;

gathering excavated material from the pile by pivotally mounting a gathering head at the marginal forward end of the conveyor; and, mounting elongated picks on the gathering heat which sweep the excavated material onto the conveyor;

discharging the gathering material from the conveyor onto a separator means; and, moving large particles of the discharged material across the separator means and returning the large particles onto the excavated material remaining in the pile; moving small particles of the discharged material through the separator means and onto a lateral conveyor thereby providing padding material;

adjusting the separator means respective to the horizontal to control the rate of flow of excavated material thereacross, and thereby control the amount of padding material that is separated from the excavated material;

positioning the discharge end of the lateral conveyor in overlying relationship respective to the ditch; so that the excavated material is processed into padding material which is placed about the pipeline lying in the ditch while the residual material from the separator is returned to the ground and can subsequently be placed in the ditch where it is separated from the pipeline by the padding material.

4. A vehicle for padding pipe lying in a previsously dug ditch wherein the vehicle includes apparatus that gathers and processes previously excavated material which lies on the ground adjacent to a pipeline ditch in a manner to provide padding material which is conveyed back into the ditch, with the residue from the processed material being returned to the previously excavated material lying on the ground adjacent to the ditch;

said vehicle has a longitudinal conveyor mounted thereon and oriented parallel to the direction of travel of the vehicle, said vehicle having means forming a gathering head at the forward marginal end thereof for continuously lifting previously excavated material from the ground and thereafter gathering the excavated material onto a lower forward end of the longitudinal conveyor; a separator means located at the rear of the vehicle; said longitudinal conveyor is inclined rearwardly and overlies said separator means;

said gathering head has forward ground engaging lip opposed to the other end, said other end is pivotally attached to the vehicle, said lip can be pivotally moved respective to the apparatus and vertically moved respective to the excavated material lying on the ground in order to gather a fraction of the previously excavated material into the apparatus for processing the excavated material into padding material;

said gathering head includes a pick means arranged in spaced relationship respective to one another, said pick means is moved with a circular motion and engages excavated material on said lip and moves the excavated material onto the forward end of the longitudinal conveyor;

said separator means is arranged at an angle respective to the horizontal, means for increasing the angle of said separator means; said separator means includes means by which padding material is separated from the excavated material, and means for returning the residual material from the separator means to the ground at the location of the previously excavated material;

a lateral conveyor means positioned in underlying relationship respective to the separator means for receiving padding material therefrom; means for translocating the padding material that the lateral conveyor receives from the separator into the ditch and thereby covering any pipe that may be found in the ditch;

whereby the residual material can subsequently be back-filled into the ditch on top of the padding material.

5. The apparatus of claim 1 wherein said gathering head includes a central slot at the pivoted end thereof, means by which said central slot receives the forward end of the longitudinal conveyor, means mounting said spaced picks on opposed sides of the forward end of the longitudinal conveyor, said picks move in an oscillatory manner and gather in material located forwardly of said lip and sweep the material onto the leading edge of said longitudinal conveyor.

* * * * *

UNITED STATES PATENT AND TRADEMARK OFFICE

CERTIFICATE OF CORRECTION

PATENT NO. : 4,633,602

DATED : January 6, 1987

INVENTOR(S) : Ricky L. Layh and Christy B. Landrum, Jr.

It is certified that error appears in the above-identified patent and that said Letters Patent is hereby corrected as shown below:

Column 8, line 1, substitute --head-- for "heat";

Column 8, line 3, substitute --gathered-- for "gathering";

Column 8, line 45, insert --a-- before "forward".

Signed and Sealed this

Seventh Day of April, 1987

*Attest:*

*Attesting Officer*

DONALD J. QUIGG

*Commissioner of Patents and Trademarks*

UNITED STATES PATENT AND TRADEMARK OFFICE

CERTIFICATE OF CORRECTION

PATENT NO. : B1 4,633,602

DATED : November 26, 1991

INVENTOR(S) : Ricky L. Layh and Christy B. Landrum, Jr.

It is certified that error appears in the above-identified patent and that said Letters Patent is hereby corrected as shown below:

On the title page, after "Assignee;", delete "CRC - Evans Pipeline International, Inc., Tex"

Column 1, line 29, after "parallel to" delete "the" and in lieu thereof insert -- a --;

Column 3, line 38, delete "returend" and in lieu thereof insert -- returned -- .

Signed and Sealed this

Seventeenth Day of March, 1992

*Attest:*

HARRY F. MANBECK, JR.

*Attesting Officer*

*Commissioner of Patents and Trademarks*

UNITED STATES PATENT AND TRADEMARK OFFICE

CERTIFICATE OF CORRECTION

PATENT NO. : B1 4,633,602

DATED : November 26, 1991

INVENTOR(S) : Ricky L. Layh; Christy B. Landrum, Jr.

It is certified that error appears in the above-identified patent and that said Letters Patent is hereby corrected as shown below:

Cover Page, after "Assignee;", delete "CRC - Evans Pipeline International, Inc., Tex" and insert -- None --;

Column 1, line 29, after "parallel to" delete "the" and in lieu thereof insert -- a --;

Column 3, line 38, delete "returend" and in lieu thereof insert -- returned -- .

Signed and Sealed this

Eighteenth Day of April, 1995

Bruce Lehman

*Attest:*

BRUCE LEHMAN

*Commissioner of Patents and Trademarks*

*Attesting Officer*

REEXAMINATION CERTIFICATE (1595th)

United States Patent [19]

Layh et al.

[11] B1 4,633,602

[45] Certificate Issued Nov. 26, 1991

[54] METHOD AND APPARATUS FOR PADDING PIPE

[75] Inventors: Ricky L. Layh; Christy B. Landrum, Jr., both of Hobbs, N. Mex.

[73] Assignee: CRC-Evans Pipeline International, Inc., Tex.

Reexamination Request:
No. 90/002,311, Apr. 1, 1991

Reexamination Certificate for:

| | |
|---|---|
| Patent No.: | **4,633,602** |
| Issued: | **Jan. 6, 1987** |
| Appl. No.: | **771,840** |
| Filed: | **Sep. 3, 1985** |

Certificate of Correction issued Jan. 6, 1987.

[51] Int. Cl.[5] ..... E02F 5/12

[52] U.S. Cl. ..... 37/195; 37/142.5; 405/179; 209/247; 209/421

[58] Field of Search ..... 405/179; 37/142.5, 195; 414/334, 335, 336, 725, 528; 171/10, 123, 136, 138, 140, 141; 209/247, 421

[56] References Cited

U.S. PATENT DOCUMENTS

| | | | |
|---|---|---|---|
| 953,226 | 3/1910 | Pontius . | |
| 1,058,016 | 4/1913 | Renfro . | |
| 1,397,343 | 11/1921 | Sturtevant . | |
| 1,522,724 | 1/1925 | Judson . | |
| 1,690,009 | 10/1928 | Hamilton . | |
| 1,792,148 | 2/1931 | Dobbins et al. . | |
| 1,860,481 | 5/1932 | Royer . | |
| 2,084,887 | 6/1937 | Bennet . | |
| 2,263,779 | 11/1941 | Jeffrey et al. . | |
| 2,300,017 | 10/1942 | Shaffer . | |
| 2,405,622 | 8/1946 | Thomas . | |
| 2,449,608 | 9/1948 | LeMay, Jr. . | |
| 2,511,039 | 6/1950 | Black et al. . | |
| 2,587,918 | 3/1952 | Stout . | |
| 2,594,666 | 4/1952 | Long . | |
| 2,602,388 | 7/1952 | Elliott et al. . | |
| 2,694,499 | 11/1954 | Mohrlang et al. . | |
| 2,708,800 | 5/1955 | Logus . | |
| 2,734,730 | 2/1956 | Talboys . | |
| 2,814,387 | 11/1957 | McWilliams | 209/247 |
| 2,857,691 | 10/1958 | Curran | 37/144 |
| 2,931,529 | 4/1960 | Osterhaus . | |
| 2,974,795 | 3/1961 | Behnke et al. . | |
| 3,210,122 | 10/1965 | Moon . | |
| 3,224,120 | 12/1965 | Wilmouth et al. . | |
| 3,314,175 | 4/1967 | Petty et al. . | |
| 3,365,050 | 1/1968 | Taylor . | |
| 3,396,481 | 8/1968 | Hovorak . | |
| 3,446,026 | 5/1969 | Fikse . | |
| 3,507,060 | 4/1970 | Gee et al. . | |
| 3,511,056 | 5/1970 | Jones et al. . | |
| 3,583,168 | 6/1971 | Horton . | |
| 3,597,927 | 8/1971 | Hemphill . | |
| 3,860,291 | 1/1975 | Rauch et al. | 299/67 |
| 3,892,443 | 7/1975 | Arentzen | 299/67 |
| 3,978,673 | 9/1976 | Schleede . | |
| 4,227,105 | 7/1981 | Taylor | 299/64 |
| 4,664,791 | 5/1987 | McClain et al. | 209/421 |

OTHER PUBLICATIONS

Exhibit V1-Trial Transcript from *Layh v. Two Rivers* vol. 1.

Exhibit V2-Trial Transcript from *Layh v. Two Rivers* vol. 2.

Exhibit V3-Trial Transcript from *Layh v. Two Rivers* vol. 3.

Exhibit V4—Trial Transcript from *Layh v. Two Rivers* vol. 4.

Exhibit V5—Trial Transcript from *Layh v. Two Rivers* vol. 5.

*Primary Examiner*—Randolph A. Reese

[57] ABSTRACT

Apparatus for gathering and processing excavated material which lies in a long pile on the ground adjacent to a ditch, so as to provide padding material which is conveyed onto a pipe lying in the ditch, with the residue from the process being returned to the ground adjacent to the ditch. The apparatus has a gathering head at the forward end thereof and a separator at the rear end thereof. A longitudinally arranged conveyor translocates the gathered material from the gathering head onto the separator. A lateral conveyor underlies the separator and translocates processed material which passes through the screen into the ditch, to thereby cover a pipeline with padding material. The separator apparatus includes means for redepositing the residual material onto the ground along a path parallel to the ditch.

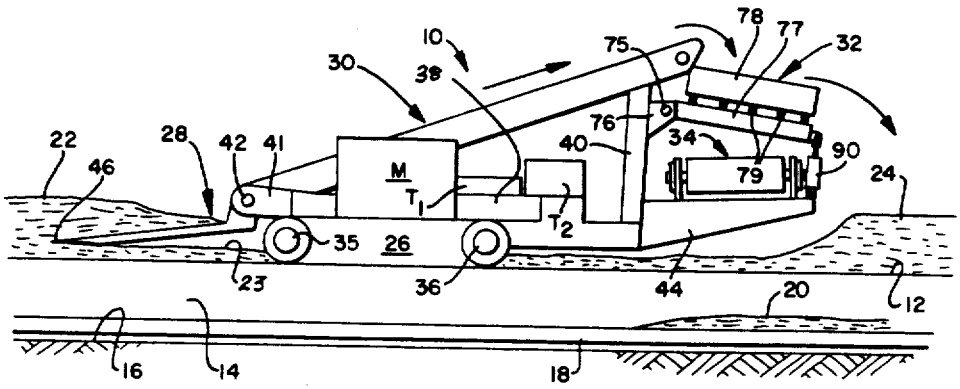

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claim 3 is confirmed.

Claims 1 and 4 are determined to be patentable as amended.

Claims 2 and 5, dependent on an amended claim, are determined to be patentable.

New claims 6-30 and 31 are added and determined to be patentable.

1. Apparatus for continuously moving along the ground parallel to the *pipeline* ditch while continuously gathering and processing excavated material which lies on the ground adjacent to [a] *the* pipeline ditch so as to enable padding material to be separated from the gathered material and conveyed back into the ditch, with the residue from the processed material being returned to the ground adjacent to the ditch;

said apparatus having a longitudinal conveyor arranged parallel to the path of travel of the apparatus, and means forming a gathering head at the forward marginal end of the conveyor for gathering excavated material from the ground and forcing the excavated material onto the leading end of the conveyor; said conveyor having a forward end opposed to a discharge end and translocates the gathered material rearwardly to an elevated position;

means by which said gathering head is pivotally mounted to said apparatus and forms the forward marginal end thereof; said gathering head has a ground engaging lip at the forward end thereof, said gathering head can be pivotally moved vertically respective to the excavated material in order to gather a controlled amount of excavated material for subsequently processing into *the* padding material;

a separator means supported at the rear end of the apparatus for separating padding material and residual processed material from the translocated gathered material; said separator means being located in underlying relationship respective to the discharge end of the longitudinal conveyor;

a lateral conveyor means positioned in underlying relationship respective to the separator means for translocating the padding material received from the separator into the ditch and thereby covering a pipe which may be located in the ditch;

and means for redepositing the residual processed material from the separator onto the remaining said material which lies on the ground along a path which is parallel to the ditch.

4. A vehicle for padding pipe lying in a previously dug ditch wherein the vehicle includes apparatus that gathers and processes previously excavated material which lies on the ground adjacent to [a] *the* pipeline ditch in a manner to provide padding material which is conveyed back into the ditch, with the residue from the processed material being returned to the previously excavated material lying on the ground adjacent to the ditch;

said vehicle has a longitudinal conveyor mounted thereon and oriented parallel to the direction of travel of the vehicle, said vehicle having a means forming a gathering head at the forward marginal end thereof for continuously lifting previously excavated material from the ground and thereafter gathering the excavated material onto a lower forward end of the longitudinal conveyor; a separator means located at the rear of the vehicle; said longitudinal conveyor is inclined rearwardly and overlies said separator means;

said gathering head has forward ground engaging lip opposed to the other end, said other end is pivotally attached to the vehicle, said lip can be pivotally moved respective to the apparatus and vertically moved respective to the excavated material lying on the ground in order to gather a fraction of the previously excavated material into the apparatus for processing the excavated material into padding material;

said gathering head includes a pick means arranged in spaced relationship respective to one another, said pick means is moved with a circular motion and engages excavated material on said lip and moves the excavated material onto the forward end of the longitudinal conveyor;

said separator means is arranged at an angle respective to the horizontal, means for increasing the angle of said separator means; said separator means includes means by which padding material is separated from the excavated material, and means for returning the residual material from the separator means to the ground at the location of the previously excavated material;

a lateral conveyor means positioned in underlying relationship respective to the separator means for receiving padding material therefrom; means for translocating the padding material that the lateral conveyor receives from the separator into the ditch and thereby covering any pipe that may be found in the ditch;

whereby the residual material can subsequently be backfilled into the ditch on top of the padding material.

*6. The apparatus as in claim 1, additionally comprising means for assisting in the gathering of excavated material, said means for assisting being movably mounted on said gathering head whereby said means for assisting is movable with respect to said gathering head.*

*7. The apparatus as in claim 6, in which said means for assisting comprises at least one gathering arm.*

*8. The apparatus as in claim 1, in which said gathering head extends wider than said longitudinal conveyor for gathering excavated material from the ground and forcing the excavated material onto the leading end of said longitudinal conveyor as said apparatus is moved forward.*

*9. The apparatus as in claim 1, said gathering head additionally comprising side walls on said gathering head.*

*10. The apparatus as in claims 1 or 9, additionally comprising picks mounted on said gathering head.*

*11. The apparatus as in claim 10, in which said picks extends forward of said ground engaging lip.*

*12. The apparatus as in claim 1, in combination with a vehicle for supporting and propelling the apparatus, said vehicle having wheel means for supporting said vehicle, said vehicle also having a frame.*

*13. The apparatus of claim 12, in which said longitudinal conveyor is supported from said vehicle frame.*

*14. The apparatus as in claim 12, in which said means mounting said gathering head for pivotal movement comprising means supporting said gathering head from said vehicle frame.*

*15. The apparatus as in claim 1, additionally comprising means mounting said gathering head for pivotal movement of said gathering head with respect to said longitudinal conveyor.*

*16. The apparatus as in claim 1, in which said longitudinal conveyor comprises a plurality of spaced conveyor elements.*

*17. The apparatus as in claim 16, in which the apparatus additionally comprises means for moving said spaced conveyor elements along an endless path for conveying excavated material.*

*18. The apparatus as in claim 1, in which said separator means additionally comprises means for moving said separator means whereby residual processed material exits from said separator means.*

*19. The apparatus as in claim 1, in which said means for redepositing comprises a pair of opposed side wall members whereby the residual processed material is guided to the ground along a path which is parallel to the ditch.*

*20. The apparatus as in claim 12, wherein said separator means is supported at a position whereby residual processed material from the separator means is returend to the ground in an area out of the path of the vehicle wheel means.*

*21. The apparatus as in claim 1, additionally comprising means pivotally mounting said separator means to pivot with respect to the horizontal.*

*22. The apparatus as in claim 21, in which said means pivotally mounting said separator means is pivotally mounted to pivot independently of the means by which the gathering head is pivotally mounted.*

*23. The process as in claim 3, wherein the step of gathering excavated material additionally comprises mounting means for assisting in the gathering of excavated material on the gathering head and moving the means for assisting with respect to the gathering head.*

*24. The process as in claim 23, wherein the step of mounting means for assisting in the gathering of excavated material comprises mounting side walls on the gathering head.*

*25. The process as in claim 3, additionally comprising the step of moving the picks with respect to the gathering head.*

*26. The process as in claim 3, in which the step of mounting picks comprises mounting picks to extend beyond the forward marginal end of the gathering head.*

*27. The process as in claim 3, in which the step of pivotally mounting the gathering head comprises pivotally mounting said gathering head with respect to the vehicle and selectively pivoting the gathering head with respect to the vehicle whereby a predetermined amount of excavated material can be gathered.*

*28. The process as in claim 27, the step of selectively pivoting the gathering head and the step of adjusting the separator means with respect to the horizontal are independently performable.*

*29. The process as in claim 3, in which the step of pivotally mounting the gathering head comprises mounting the gathering head for pivotal movement with respect to the conveyor and selectively pivoting the gathering head whereby a predetermined amount of excavated material can be gathered.*

*30. The process as in claim 3, in which the step of adjusting the separator means comprises rotating the separator means about a horizontally extending axis.*

*31. The process as in claim 3, in which the step of adjusting the separator means comprises pivotally mounting the separator means with respect to the vehicle and selectively pivoting the separator means with respect to the vehicle.*

* * * * *